US012448184B2

(12) United States Patent
Brunet

(10) Patent No.: US 12,448,184 B2
(45) Date of Patent: Oct. 21, 2025

(54) FLUID PRODUCT DISPENSING DEVICE WITH SAFETY CAP

(71) Applicant: APTAR FRANCE SAS, Le Neubourg (FR)

(72) Inventor: Dominique Brunet, Barc (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 17/922,201

(22) PCT Filed: Apr. 28, 2021

(86) PCT No.: PCT/FR2021/050732

§ 371 (c)(1),
(2) Date: Oct. 28, 2022

(87) PCT Pub. No.: WO2021/219958

PCT Pub. Date: Nov. 4, 2021

(65) Prior Publication Data

US 2023/0264868 A1 Aug. 24, 2023

(30) Foreign Application Priority Data

Apr. 30, 2020 (FR) ..... 2004335

(51) Int. Cl.
*B65D 50/04* (2006.01)

(52) U.S. Cl.
CPC ..... *B65D 50/046* (2013.01); *B65D 2215/02* (2013.01)

(58) Field of Classification Search
CPC ... B65D 50/061; B65D 50/046; B65D 50/045
See application file for complete search history.

(56) References Cited

U.S. PATENT DOCUMENTS 3,559,832 A * 2/1971 Balducci ..... B65D 50/061 215/45
4,376,497 A * 3/1983 Mumford ..... B65D 50/046 222/153.14

(Continued)

FOREIGN PATENT DOCUMENTS

CH 620649 A5 * 12/1980
DE 10 2013 220 492 A1 4/2015

(Continued)

OTHER PUBLICATIONS

International Search Report for PCT/FR2021/050732 dated Aug. 23, 2021.

(Continued)

*Primary Examiner* — Allan D Stevens
(74) *Attorney, Agent, or Firm* — Sughrue Mion, PLLC

(57) ABSTRACT

Fluid product dispensing device having a dispensing member with a ring, and a safety cap removably secured to the ring. The cap has, on its lower edge, two diametrically opposite internal profiles and two diametrically opposite external markings, the internal profiles offset by 90° with respect to the external markings, the ring having two diametrically opposite external profiles that match to the internal profiles, the internal and external profiles engaging with one another when the cap is in the secured position. To be removed the cap requires first a radial pressure on the external markings of the cap disengaging the internal profiles from the external profiles, then rotation. Each external profile of the ring has a radially projecting projection in the shape of an inverted T, with an axially oriented central branch connected at its lower end to two lateral branches extending laterally on either side of the central branch.

3 Claims, 3 Drawing Sheets

(56) References Cited

U.S. PATENT DOCUMENTS

Figure 1:
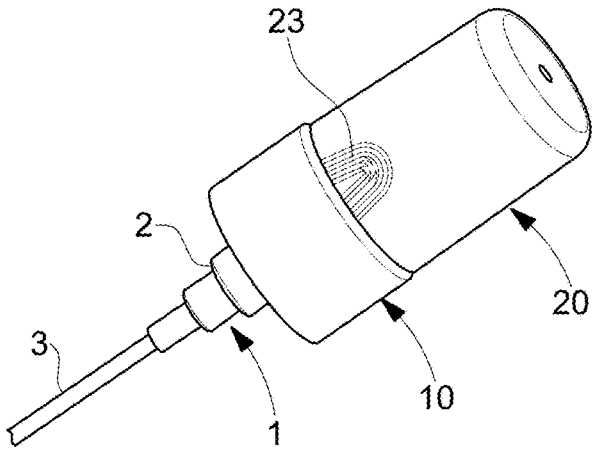

| | | | | |
|---|---|---|---|---|
| 4,588,097 | A * | 5/1986 | Hauser | B65D 50/045 215/216 |
| 4,633,370 | A * | 12/1986 | Hamuro | H05K 13/0038 361/679.01 |
| 6,105,801 | A * | 8/2000 | Minnette | B65D 1/023 215/331 |
| 6,149,022 | A * | 11/2000 | Akyildiz | B65D 50/061 401/129 |
| 6,758,358 | B1 * | 7/2004 | Bloom | B65D 50/061 215/206 |
| 7,334,694 | B2 | 2/2008 | Suffa | |
| 10,081,459 | B2 * | 9/2018 | Painchaud | B65D 51/18 |
| 2004/0222181 | A1 * | 11/2004 | Biesecker | B65D 50/046 215/218 |
| 2008/0142468 | A1 * | 6/2008 | Delagrange | B65D 47/0804 215/209 |
| 2009/0255896 | A1 * | 10/2009 | DeJonge | B65D 50/046 215/206 |
| 2013/0214004 | A1 * | 8/2013 | Dejonge | B65D 50/061 220/345.3 |
| 2016/0243319 | A1 * | 8/2016 | Szymiczek | A61M 11/007 |
| 2017/0057710 | A1 * | 3/2017 | Greiner-Perth | B65D 50/00 |
| 2018/0319556 | A1 * | 11/2018 | Straughan | B65D 43/0212 |
| 2020/0031540 | A1 * | 1/2020 | Dzurik | B65D 47/0838 |
| 2021/0053729 | A1 * | 2/2021 | Benoit-Gonin | B65D 83/22 |

FOREIGN PATENT DOCUMENTS

| | | | | |
|---|---|---|---|---|
| FR | 1 571 929 | A | 6/1969 | |
| FR | 2 911 329 | A1 | 7/2008 | |
| WO | WO-0056621 | A1 * | 9/2000 | B65D 41/0414 |
| WO | 2019/200486 | A1 | 10/2019 | |

OTHER PUBLICATIONS

International Preliminary Report on Patentability(PCT/IB/373) dated Aug. 3, 2022 issued by the International Searching Authority in International Application No. PCT/FR2021/050732.

* cited by examiner

FLUID PRODUCT DISPENSING DEVICE WITH SAFETY CAP

CROSS REFERENCE TO RELATED APPLICATIONS

This application is a National Stage of International Application No. PCT/FR2021/050732 filed Apr. 28, 2021, claiming priority based on French Patent Application No. 2004335 filed Apr. 30, 2020.

The present invention relates to a safety cap and a fluid product dispensing device incorporating such a cap. More specifically, the present invention relates to a safety cap for a oral or nasal-type spray device.

In the field of fluid product dispensers, in particular pharmaceutical, it can be necessary to avoid an undesired actuation of the device by certain people, such as children. Indeed, the product contained in the dispensing device can have a significant danger for a child, if they actuate the dispenser accidentally. The devices thus comprise a safety cap, the aim of which is to avoid access to the device which is too easy. Caps of this type generally require exercising an axial pressure on the cap, with a rotation simultaneous to this axial pressure. This manoeuvre can prove to be difficult, even for weak adults or elderly people.

Documents DE102013220492, FR2911329, U.S. Pat. No. 7,334,694, FR1571929 and WO2019200486 describe prior-art devices.

The present invention aims to provide a safety cap which does not have the abovementioned disadvantages.

In particular, the present invention aims to provide a safety cap which does not require the application of an axial pressure on the cap simultaneously to a rotation of the cap.

The present invention also aims to provide a safety cap which is simple and inexpensive to manufacture and to assemble.

The present invention therefore relates to a fluid product dispensing device comprising a dispensing member, such as a pump or a valve, provided with a ring, such as a securing ring, and a safety cap removably secured to said ring, said safety cap comprising, on its lower edge, two diametrically opposite internal profiles and two diametrically opposite external markings, said internal profiles being offset by 90° from said external markings, said ring comprising two diametrically opposite external profiles that match to said internal profiles of said safety cap, said internal and external profiles engaging with one another when said safety cap is in the secured position to hold it securely on said ring, and said safety cap requiring, to be removed from said ring, first a radial pressure on said external markings of said safety cap to thus disengage said internal profiles from said external profiles, then a rotation of said compressed safety cap with respect to said ring, in order to allow said safety cap to be removed by an axial movement, each external profile of said ring comprising a radially projecting projection in the shape of an inverted T, with an axially oriented central branch connected at its lower end to two lateral branches extending laterally on either side of said central branch.

Advantageously, a second projecting profile is disposed above the upper end of said central branch, in the upright position of the device, said second projecting profile being defined in said ring between a lower shoulder and an upper shoulder.

Advantageously, each second projecting profile extends radially outwards beyond said respective central branch, which itself extends radially outwards beyond its lateral branches.

Advantageously, each internal profile of said safety cap comprises a recess in the shape of an inverted T, with an axially oriented central recess connected at its lower end to two lateral recesses extending laterally on either side of said central recess.

Advantageously, each central recess extends radially inwards beyond its two lateral recesses.

Advantageously, in the securing position, with said internal profiles of said safety cap engaged on said external profiles of said ring, a radial gap is provided between said safety cap and said ring at said external markings, said radial gap allowing a radial compression of said lower edge of said safety cap.

Figure 2:
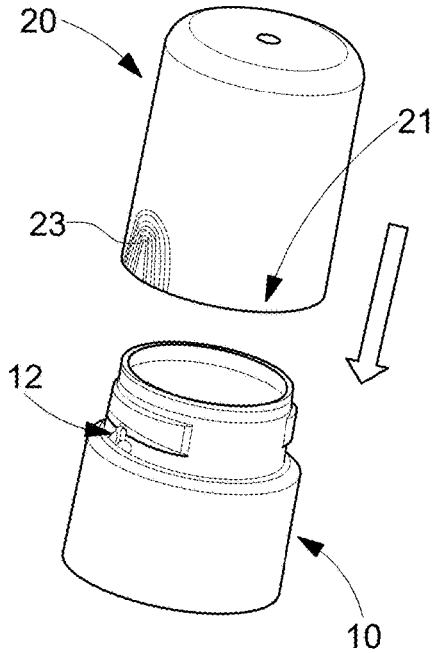
Figure 3:
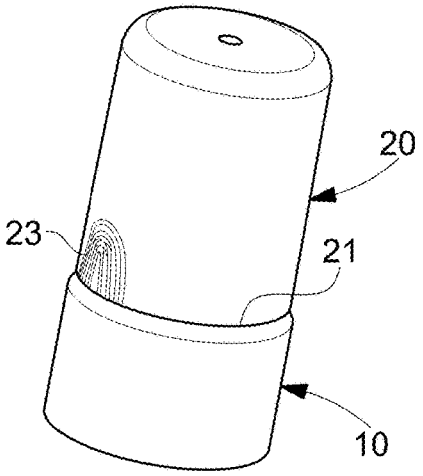
Figure 4:
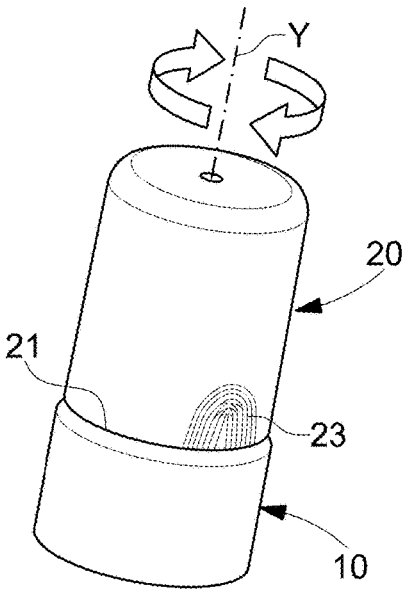
Figure 5:
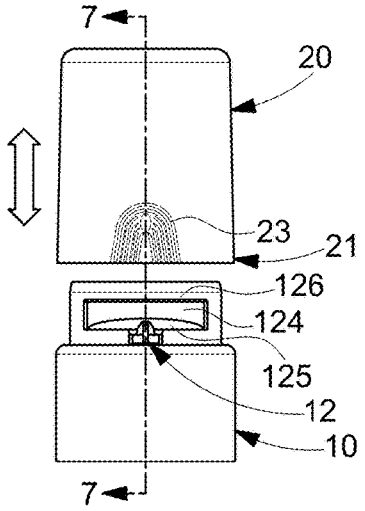
Figure 6:
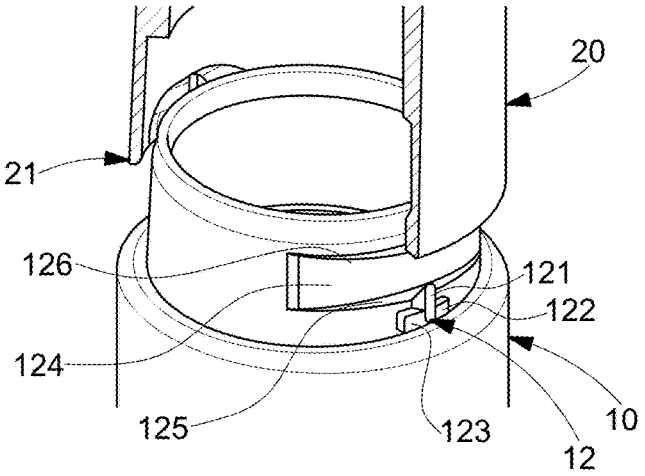
Figure 7:
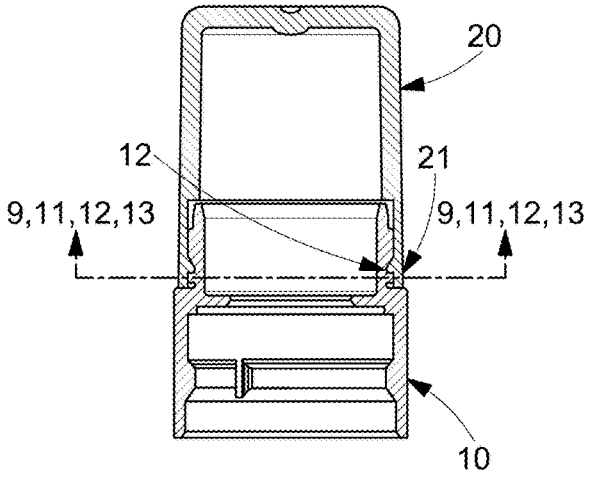
Figure 8:
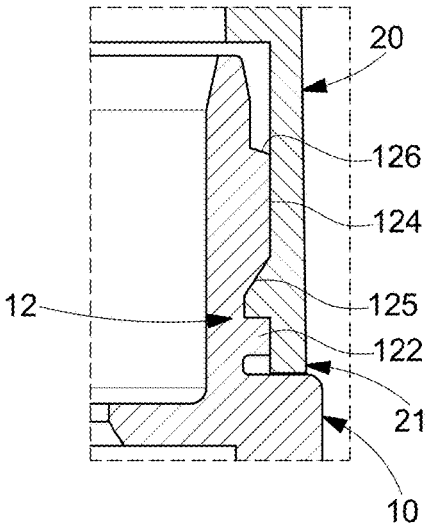
Figure 9:
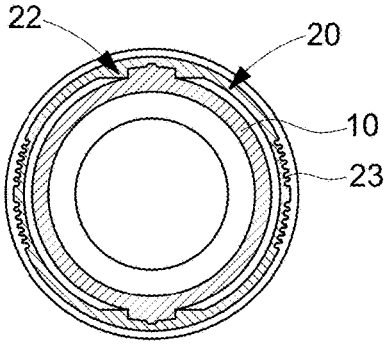
Figure 10:
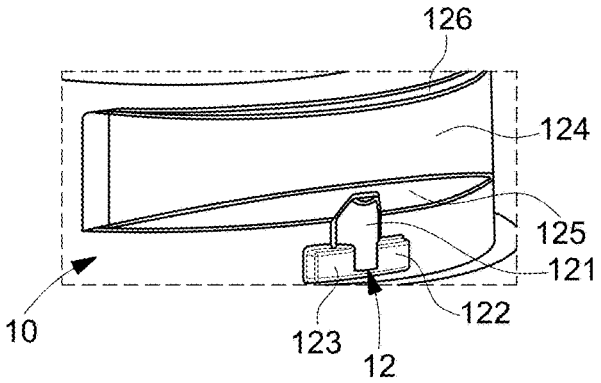
Figure 11:
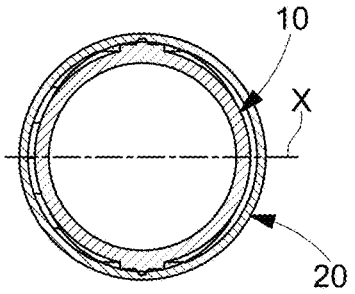
Figure 12:
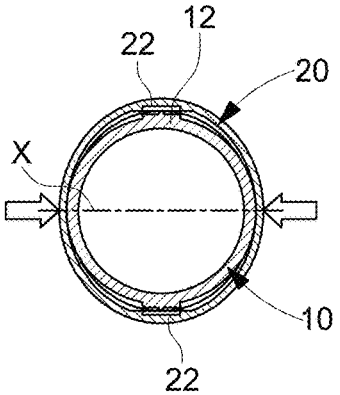
Figure 13:
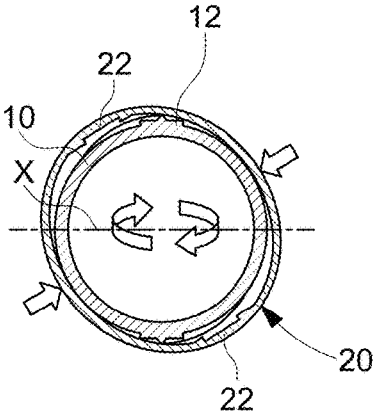
Figure 14:
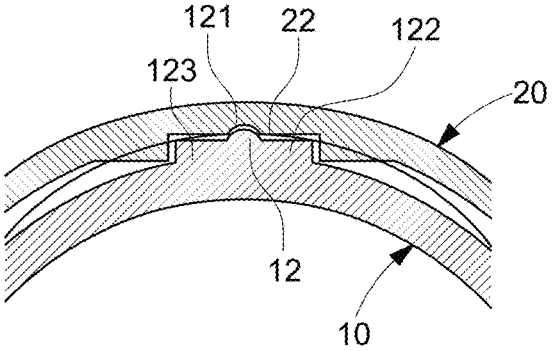
Figure 15:
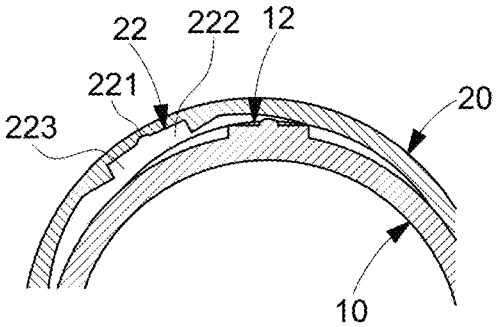
Figure 16:
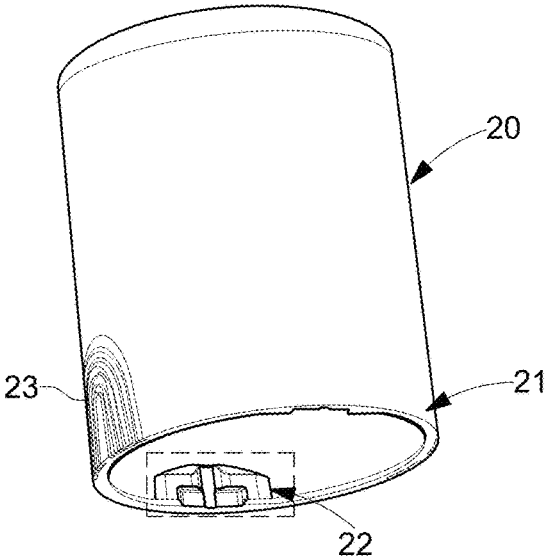
Figure 17:
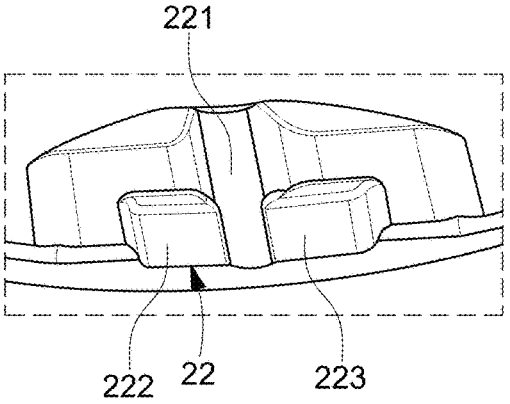

These features and advantages and others of the present invention will appear more clearly in the following detailed description given as a non-limiting example, in reference to the accompanying drawings, wherein:

FIG. 1 is a schematic, perspective view of a safety cap assembled on a dispensing member of a fluid product dispensing device, according to an advantageous embodiment of the present invention, FIG. 2 is an exploded, perspective view of the safety cap of FIG. 1, before securing on a ring of the dispensing member, FIG. 3 is a view similar to that of FIG. 2, with the safety cap placed on the ring, but before rotation to secure it, FIG. 4 is a view similar to that of FIG. 3, after securing of the safety cap to the ring, FIG. 5 is a schematic, side view, illustrating the correct orientation of the safety cap with respect to the ring to place the cap on the ring, FIG. 6 is a detailed, schematic view, as a cross-sectional perspective, showing that it is impossible to place the safety cap on the ring when the orientation is not correct, FIG. 7 is a schematic, vertical, cross-sectional view of the safety cap secured to the ring taken along line 7-7 of FIG. 5, FIG. 8 is a detailed, enlarged view of FIG. 7, FIG. 9 is a horizontal, cross-sectional view of the safety cap secured to the ring taken along line 9-9 of FIG. 7, FIG. 10 is a detailed, enlarged, perspective view of the profile of securing to the ring, FIGS. 11 to 13 illustrate horizontal, cross-sectional views of three positions during removal of the safety cap taken along lines 11-11, 12-12, 13-13 of FIG. 7, respectively in the secured position, in the radially compressed, but unrotated position, and in the radially compressed and rotated position, FIG. 14 is a detailed, enlarged view of the secured position of FIG. 11, FIG. 15 is a detailed, enlarged view of the compressed and rotated position of FIG. 13, FIG. 16 is a schematic, perspective view of the safety cap, showing the internal profile of the cap, and FIG. 17 is a detailed, enlarged view of the profile of the cap.

In the description below, the terms "top", "bottom", "lower", "upper", "horizontal" and "vertical" refer to the upright position represented in FIG. 5, and the terms "axial" and "radial" refer to the longitudinal central axis Y of the device.

In reference to the figures, an embodiment of the invention is represented. It is understood that the present invention is not limited to this embodiment, but applies, on the contrary, to all types of fluid product dispensing devices.

The fluid product dispensing device comprises a safety cap 20 which is intended to be removably secured to the dispensing device.

In the example of FIG. 1, the cap 20 is secured to a ring 10, in particular a securing ring allowing to secure a dispensing member 1, such as a pump or a valve, to a reservoir.

More specifically, FIG. 1 shows a pump 1 provided with a body 2 and a dip tube 3. This is only an example of an embodiment.

Advantageously, the device comprises a dispensing head (not represented) provided with a dispensing orifice. The aim of the safety cap is in particular to prevent the dispensing of the fluid product contained in the device by a child, but also to protect the dispensing orifice between two actuations.

According to the invention, the safety cap 20 requires, to be removed from the ring 10, first a radial pressure on the lower edge 21 of the cap 20 along the axis X, then rotation of said compressed cap 20 radially with respect to said ring 10 about the axis Y. This thus allows an axial movement of the cap 20 to remove it from the ring 10. This removal sequence of the cap 20 is illustrated in FIGS. 11 to 13.

Conversely, to be secured to the ring 10, the cap 20 is first axially moved to be placed on the ring 10, then it is subjected to rotation with respect to said ring 10 about the axis Y, preferably with simultaneously a radial pressure exerted on the lower edge 21 of the cap 20. This securing sequence of the cap 20 is illustrated in FIGS. 2 to 4.

As can be seen, in particular in FIGS. 7 to 9 and 11 to 17, the cap 20 comprises, on its lower edge 21, two diametrically opposite internal profiles 22 and two diametrically opposite external markings 23, said internal profiles 22 being offset by 90° from said external markings 23.

The external markings 23 can be of any form, for example, visual and/or tactile markings, to indicate to the user where to press to achieve the necessary radial pressure, in particular for the removal of the cap.

The internal profiles 22 match external profiles 12 made on the ring 10 and which are also diametrically opposite.

In the secured position, with the internal profiles 22 of the cap engaged on the external profiles 12 of the ring, the cap 20 is therefore in contact with the ring at said profiles, while at the external markings 23, which are offset by 90°, there is a radial gap between the cap 20 and the ring 10. This radial gap allows a radial compression of the lower edge 21 of the cap.

Each external profile 12 of the ring comprises a radially projecting projection in the shape of an inverted T, with an axially oriented central branch 121 connected at its lower end to two lateral branches 122, 123 extending laterally on either side of said central branch 121.

Similarly, each internal profile 22 of the cap comprises a recess in the shape of an inverted T, with an axially oriented central recess 221 connected at its lower end to two lateral recesses 222, 223 extending laterally on either side of said central recess 221.

Above the upper end of the central branch 121, in the orientation of the upright position represented, in particular in FIG. 8, a second projecting profile 124 is provided, defined in the external wall of the ring 10 between a lower shoulder 125 and an upper shoulder 126, as can be seen, in particular, in FIGS. 6, 8 and 10.

To remove the safety cap 20 from the ring 10, it is necessary according to the invention to first exert a radial pressure on the lower edge 21 of said cap 20 along the axis X as represented in FIG. 12. This allows to deform the lower edge 21 of the cap 20 to disengage the internal profiles 22 of the external profiles 12. With this radial compression along the axis X, the cap 20 can be rotated about the axis Y, to angularly move the internal profiles 22 away from the external profiles 12. The cap 20 can thus be easily removed by a simple axial traction on it.

Each second projecting profile 124 extends radially outwards beyond the respective central branch 121, which itself extends radially outwards beyond its lateral branches 122, 123. Likewise, each central recess 221 extends radially inwards beyond its two lateral recesses 222, 223. Thus, when the user compresses the lower edge 21 of the cap 20 at the external markings 23, they will disengage the central and lateral recesses 221, 222, 223 from the lateral branches 122, 123 and from the central branches 121, but not from the second projecting profiles 124, such that without rotation of the cap 20, this cannot be removed, the internal profiles 22 remaining axially blocked by the lower shoulders 125 of each second projecting profile 124. This is only after a rotation that the cap can be easily removed from the ring, when the internal profiles 22 no longer engage with the second projecting profiles 124. This rotation is advantageously by 90°, but a lower rotation can be sufficient. Thus, FIG. 13 illustrates such a disengaged position after a rotation of around 30° only. Thus, the angle of rotation will be determined by the lateral extent of the second projecting profiles 124.

The second projecting profiles 124 also form an axial abutment preventing the user from assembling the cap on the ring in any orientation. Thus, if the user attempts to axially place the cap 20 on the ring 10 with the internal profiles 22 of the cap 20 located at the external profiles 12 of the ring 10, then the upper shoulder 126 will block this axial movement of the ring, as illustrated in FIG. 6.

Thus, the ideal position for assembling the cap 20 on the ring, is to align the external markings 23, which are offset by 90° from the internal profiles 22, with the external profiles 12 of the ring, as illustrated in FIGS. 2 and 5. The cap can thus be easily axially placed on the ring, then a rotation of 90° will engage the internal profiles 22 of the cap with the external profiles 12 of the ring to secure the cap.

Advantageously, the user compresses the lower edge 21 of the cap at the external markings 23 to achieve this rotation. However, it can be considered to be able to achieve this rotation without the radial compression of the lower edge, for example by providing internal and external profiles 22, 12 which have inclined slopes, such that during the rotation of the cap, its lower edge 21 will automatically be radially deformed to allow the snap-fitting of the internal profiles 22 on the external profiles 12.

The present invention therefore provides a system which is very simple to produce and to manufacture and which is therefore inexpensive, which allows to ensure it is safe against accidental use by children, by involving a necessity for a double manipulation to remove the cap, namely a radial pressure followed by a rotation.

The present invention has been described in reference to a particular embodiment of it, but it is clear that various modifications are possible without moving away from the scope of the present invention such as defined by the accompanying claims.

The invention claimed is:

1. A fluid product dispensing device comprising:

a dispensing member, provided with a ring and a safety cap removably secured to said ring, said safety cap comprising, on a lower edge of said safety cap, two diametrically opposite internal profiles and two diametrically opposite external markings, said internal profiles being offset by 90° from said external markings, wherein said ring comprises two diametrically opposite external profiles that match said internal profiles of said safety cap, said internal and external profiles engaging in one another in a secured position of said safety cap to hold said safety cap securely on said ring, and wherein said safety cap requires, in order to be removed from said ring, first a radial pressure on said external markings of said safety cap to thus disengage said internal profiles from said external profiles, then rotation of said compressed safety cap with respect to said ring, in order to allow said safety cap to be removed by an axial movement, wherein each of said external profiles of said ring comprises a radially projecting projection in a shape of an inverted T formed by an axially oriented central branch connected at a lower end of said central branch to two lateral branches extending laterally on either side of said central branch, wherein, for each radially projecting projection in the shape of the inverted T, a second projecting profile is disposed above an upper end of said central branch, in an upright position of the device, said corresponding second projecting profile being defined in said ring between a lower shoulder and an upper shoulder, said corresponding second projecting profile extends radially outwards beyond said corresponding central branch, said corresponding central branch extending radially outwards beyond the corresponding lateral branches extending laterally on either side of said corresponding central branch;

wherein each internal profile of said safety cap comprises a recess in the shape of an inverted T, with an axially oriented central recess connected at a lower end of said central recess to two lateral recesses extending laterally on either side of said central recess; and wherein each central recess extends radially outwards beyond said two lateral recesses.

2. The device according to claim 1, wherein, in the secured position, with each of said internal profiles of said safety cap engaged on a corresponding one of said external profiles of said ring, a radial gap is provided between said safety cap and said ring at said external markings, said radial gap allowing a radial compression of said lower edge of said safety cap.

3. The device according to claim 1, wherein the dispensing member is a pump or a valve.

* * * * *